US010602594B2

(12) United States Patent
Svensson et al.

(10) Patent No.: US 10,602,594 B2
(45) Date of Patent: Mar. 24, 2020

(54) DRIVE CIRCUIT FOR A FLASH TUBE AND A METHOD FOR CONTROLLING THE DRIVE CIRCUIT

(71) Applicant: PROFOTO AB, Sundbyberg (SE)

(72) Inventors: Johnny Svensson, Sollentuna (SE); Carl Johan Grubbström, Saltsjö-boo (SE)

(73) Assignee: PROFOTO AB, Sundbyberg (SE)

( * ) Notice: Subject to any disclaimer, the term of this patent is extended or adjusted under 35 U.S.C. 154(b) by 0 days.

(21) Appl. No.: 16/331,519

(22) PCT Filed: Sep. 5, 2017

(86) PCT No.: PCT/SE2017/050879
§ 371 (c)(1),
(2) Date: Mar. 7, 2019

(87) PCT Pub. No.: WO2018/048341
PCT Pub. Date: Mar. 15, 2018

(65) Prior Publication Data

US 2019/0208610 A1 Jul. 4, 2019

(30) Foreign Application Priority Data

Sep. 9, 2016 (SE) ..... 1651216

(51) Int. Cl.
*H05B 41/32* (2006.01)
*G05F 1/10* (2006.01)

(52) U.S. Cl.
CPC ..... *H05B 41/32* (2013.01); *G05F 1/10* (2013.01)

(58) Field of Classification Search
CPC ..... H05B 41/32; G05F 1/10
See application file for complete search history.

(56) References Cited

U.S. PATENT DOCUMENTS 4,302,707 A 11/1981 Hattori
5,109,248 A 4/1992 Petrakos et al.
(Continued)

FOREIGN PATENT DOCUMENTS

EP 1848252 A2 10/2007
JP 02-100028 A 4/1990
(Continued)

OTHER PUBLICATIONS

International Search Report and Written Opinion of the International Searching Authority for International Application No. PCT/SE2017/050879, dated Oct. 11, 2017, in 13 pages.
(Continued)

*Primary Examiner* — Raymond R Chai
(74) *Attorney, Agent, or Firm* — Knobbe, Martens, Olson & Bear, LLP

(57) ABSTRACT

The invention discloses a drive circuit and a method for controlling a drive circuit for a flash tube. The drive circuit comprises a capacitor and a first inductor switch group comprising a first inductor and at least one first switch connected in series with each other. The first inductor switch group is configured to be connected in series with the flash tube and the capacitor. The drive unit further comprises at least a second inductor switch group comprising a second inductor and at least one second switch connected in series with each other and configured to be connected in series with the flash tube and the capacitor, and in parallel with the first inductor switch group. The method further comprises the steps of receiving input parameters related to a desired flash characteristics, and controlling the first and second switches separately based on the received input parameters to obtain the desired flash characteristics.

12 Claims, 5 Drawing Sheets

(56) References Cited

U.S. PATENT DOCUMENTS

| | | | | |
|---|---|---|---|---|
| 2004/0085026 | A1 | 5/2004 | Inochkin et al. | |
| 2004/0232899 | A1 | 11/2004 | Herbert | |
| 2008/0074055 | A1* | 3/2008 | Peterson | H05B 41/32 315/241 P |
| 2013/0230305 | A1* | 9/2013 | Falk | G01J 3/505 396/164 |
| 2015/0373818 | A1* | 12/2015 | Otterberg | H05B 41/36 315/209 R |
| 2017/0061752 | A1* | 3/2017 | Chen | G05F 3/02 |
| 2017/0064786 | A1* | 3/2017 | Tan | G08B 5/38 |
| 2017/0310218 | A1* | 10/2017 | Chan | H02M 3/137 |

FOREIGN PATENT DOCUMENTS

| | | | |
|---|---|---|---|
| JP | 2005-310624 | A | 11/2005 |
| WO | WO 2014/126528 | A1 | 8/2014 |

OTHER PUBLICATIONS

Swedish Search Report for Sweden Patent Application No. 1651216-2, dated Mar. 24, 2017, in 3 pages.

Buck converter, Jul. 2016, Retrieved from the Internet: https://en.wikipedia.org/wiki/Buck_converter, Dated by WayBackMachine: https://web.archive.org/web/20160724232314/https://en.wikipedia.org/wiki/Buck_converter; whole document.

Extended European Search Report for European Patent Application No. 17849201.3, dated Jan. 31, 2020, in 7 pages.

* cited by examiner

DRIVE CIRCUIT FOR A FLASH TUBE AND A METHOD FOR CONTROLLING THE DRIVE CIRCUIT

CROSS-REFERENCE TO RELATED APPLICATIONS

This application is the U.S. National Phase under 35 U.S.C. § 371 of International Application PCT/SE2017/050879, filed Sep. 5, 2017, which claims priority to SE Application No. 1651216-2, filed Sep. 9, 2016, the entire contents of each of which are incorporated by reference herein and made a part of this specification.

TECHNICAL FIELD

The invention relates to a method and a flash apparatus for controlling a drive circuit for a flash tube.

BACKGROUND ART

Generally, in a flash apparatuses, it is desirable to control the intensity and the colour temperature of the light emitted from the flash tube during a flash as well as the total amount of light emitted from the flash tube.

A flash apparatus typically comprises a generator comprising at least one capacitor configured to apply a voltage to the flash tube. The flash tube comprises a fluid, for example a gas. The fluid in the flash tube is in a normal state an insulator. When a flash is desired, a triggering of the flash tube is performed. There are several methods of triggering the flash tube. For example, a triggering electric current may be supplied to a wire arranged in or around the flash tube. The triggering electric current ionizes parts of the fluid in the flash tube, which causes the fluid to start conducting electric current between the electrodes of the flash tube. The electrical contact between the electrodes of the flash tube allows the at least one capacitor to discharge, causing a pulse of electric current to be led through the fluid in the flash tube. This pulse of electric current causes the fluid in the flash tube to emit light. The emitted light has a certain intensity and a certain colour temperature at each point in time during the flash. In addition, a total amount of light is emitted during the flash. The characteristics of the emitted light is dependent on the energy supplied to the flash tube.

The colour temperature of the total amount of light emitted from the flash tube during a flash is an important factor when the flash is used for photographic purposes. In the beginning of the flash, that is, in the beginning of the discharge of the capacitor, normally, light with a higher colour temperature is emitted from the flash tube. At the end of the flash, that is, at the end of the discharge of the capacitor, light with a lower colour temperature is emitted from the flash tube. It is desirable to be able to control the colour temperature of the flash.

In addition, or alternatively, it is desirable to control the intensity of light emitted during a flash and/or the total amount of light emitted from the flash tube during a flash.

One method of controlling the total amount of light and the intensity of the light emitted from a flash tube is to adjust the charging voltage of the capacitors of the generator. The lower the voltage applied to the flash tube, the lower the total amount of light and the intensity of the light emitted during the flash. However, the adjustment of the charging voltage also affects the colour temperature of the emitted light.

Another method of controlling the characteristics of the light emitted from the flash tube during a flash is to cut the electrical current supplied to the flash tube at a certain time before the capacitors have discharged completely. By cutting the current to the flash tube at a certain time, the flash tube will stop emitting light and hence, the characteristics of the light emitted from the flash tube may be controlled. With this method, for example a change in colour temperature of the light emitted from a flash tube during a flash caused by a change in charging voltage of the capacitors may be compensated for by cutting the electrical current to the flash tube at a certain point in time.

Another way of controlling the light emitted from a flash tube is to control the current from the capacitor to the flash tube as the capacitor discharges. This may be performed by switching a switch in the drive circuit on and off, thereby interrupting the current in the drive circuit at certain intervals. By varying the current supplied to the flash tube, the intensity, the colour temperature of the emitted light and the total amount of emitted light can be controlled.

WO2014126528 describes a drive circuit for a flash tube wherein a switch is used in order to control the current in the drive circuit.

One problem associated with this technique of interrupting the power supply to the flash tube during the discharge of the capacitor in the drive circuit is that due to the large amount of energy transmitted to the flash tube during a flash the components of the drive circuit for the flash tube are exposed to a large strain which may cause damage on the components and thereby failure of the flash. Another problem with the prior art is that the switch has a maximum switching rate. Hence, the current in the drive circuit may only be turned on and off a certain amount of times during one second. This switching rate affects how accurate the control of the current supplied to the flash tube will be.

The above mentioned problems occur when controlling the power supplied to a flash tube in all fields of technology.

US20040085026, which concerns pulsed flash lamps used in a variety of applications such a cosmetology, describes one method of protecting the components of a drive circuit of a pulsed flash lamps.

There is a need and desire for a method to control the power supply to a flash tube during a flash and at the same time protect the components of a drive circuit.

SUMMARY

It is an object of the present invention to present a method and a drive circuit for improved control of the light emitted from a flash tube during a flash. It is a particular object of the present invention to present a method and a drive circuit for solving or at least mitigating one or more of the above mentioned problems associated with flashes according to prior art.

According to one aspect of the present disclosure, these objects are achieved by a drive circuit comprising a capacitor, a first inductor switch group comprising a first inductor and at least one first switch connected in series with each other. The first inductor switch group is configured to be connected in series with a flash tube and the capacitor. The drive circuit further comprises a control unit comprising receiving means for receiving at least one input parameters related to a desired flash characteristics. Further, the drive circuit comprises a second inductor switch group comprising a second inductor and at least one second switch connected in series with each other. The second inductor switch group is configured to be connected in series with the flash tube and the capacitor, and being connected in parallel with the first inductor switch group. The control unit is configured to control the first and second inductor switch groups separately based on the at least one input parameter to obtain the desired flash characteristics.

The control unit is configured to control the first and second inductor switch group individually based on the at least one input parameter in order to obtain the desired flash characteristics. Hence, each inductor switch group is separately connected to the control unit and can be controlled separately, independent from any other inductor switch group in the drive circuit.

With a first inductor switch group and a second inductor switch group connected in parallel with each other in the drive circuit, the current in the drive circuit is led through both the inductor switch groups as long as the switches are turned on. In order to control the current in the drive circuit and thereby in the flash tube, the switches of the inductor switch groups are turned on and off. By using two inductor switch groups instead of one (according to prior art), the strain on the components, caused by for example high current flows, can be kept at a lower level than if only one inductor switch group was used. This will lower the risk of damaging the components of the drive circuit. A flash apparatus with a longer lifetime will hence be achieved. The cost of the drive circuit can be reduced compared to drive circuits in the prior art since alternative cheaper components with a lower tolerance of a maximum current flow may be used.

Alternatively, a larger current flow may be used in the drive circuit for the flash tube, than in prior art. By using larger current flows, the possibilities to create a flash with desired characteristics is increased. By including a first inductor switch group and a second inductor switch group connected in parallel with each other in the drive circuit of the flash apparatus, and by controlling the switches of the inductor switch groups individually in an accurate way, the components of each inductor switch group may have a capacity of a maximum flow of current, which is lower than the total flow of current in the drive circuit as the capacitor discharges.

In addition, by including a first inductor switch group and a second inductor switch group connected in parallel with each other the possibilities to control the current from the capacitor to the flash tube in the drive circuit will increase, creating a flash which can be controlled more accurately than the flashes in prior art. In order to achieve an emitted light from the flash tube with a constant intensity and a constant color temperature, which may be required for a specific situation, the current flow to the flash tube should be constant. However, due to the laws of electronics, the current flow to the flash tube from a capacitor in a drive circuit varies during the discharge of the capacitor. By including two individually controlled inductor switch groups in the drive circuit, through which the current flow from the capacitor is led to the flash tube, the current flow to the flash tube can be altered more accurately than in prior art, for example by turning off only one of the at least one switch of each inductor switch group while the at least one switch of the other inductor switch group is turned on achieving a more even distribution of current flow to the flash tube.

In addition, by including two inductor switch groups, which are separately controlled, in the drive circuit, the control of the current from the capacitor to the flash tube in the drive circuit may be varied at a faster rate compared with prior art where only one inductor switch group is used. Each switch has a maximum switching rate, and by using two inductor switch groups where the at least one switch of each group is individually controlled a faster variation of the current fed to the flash tube in the drive circuit may be achieved, thereby making it easier to accurately control the current flow from the capacitor to the flash tube in the drive circuit.

In one exemplary embodiment, the drive circuit comprises at least a third inductor switch group where each inductor switch group comprises an inductor and at least one switch connected in series with each other. Each inductor switch group is configured to be connected in series with the electronic flash tube and the capacitor, and connected in parallel with the first inductor switch group as well as the second inductor switch group. The control unit is configured to control each inductor switch group separately.

In other words, each inductor switch group in the drive circuit is connected to the control unit separately enabling a separate control of each individual inductor switch group regardless of the number of inductor switch groups comprised in the drive circuit.

By adding further inductor switch groups an even more accurate control of the flash may be achieved, and at the same time, the strain on the components may decrease. According to one exemplary embodiment, the drive circuit comprises four inductor switch groups. By using three or more inductor switch groups, an even faster variation of the current flow fed to the flash tube may be achieved by controlling the at least one switch of each inductor switch groups individually. A fast variation of the current flow in the drive circuit may be advantageous when a certain characteristics of the emitted light during a flash is desired. In addition, as mentioned above, components with a maximum capacity of current flowing through the components on a level below the total current flow from the capacitor in the drive circuit may be used. Hence, cheaper components may be used or alternatively, larger current flows may be used with the same components as in prior art and also, a longer lifetime of the drive circuit may be achieved.

In order to be able to control the flash emitted from the flash tube, the control unit of the drive circuit comprises receiving means for receiving at least one input parameter. Typically, the input parameter relates to any of, or any combination of: a desired color temperature of the flash, a desired light intensity of the flash and a desired total amount of light emitted during the flash.

The drive circuit according to the present disclosure is user friendly. A user may input at least one relevant input parameter into the drive circuit. The input parameter/s may, according to one aspect of the present disclosure, relate to a predefined switch algorithm wherein the control unit is configured to use the predefined switch algorithm during the flash.

The switch algorithm is an algorithm defining a time schedule for the control of the at least one switch in each individual inductor switch group of the drive circuit. The time schedule defines when in time the at least one switch in each individual inductor switch group should be turned on and off. By controlling the at least one switch of each individual inductor switch group separately, the current flow from the capacitor to the flash tube in the drive circuit during the capacitor discharge is controlled. Since the light emitted from a flash tube corresponds to the current flow through the flash tube, the switch algorithm will affect the light emitted from the flash tube and hence, the light emitted from the flash tube is controlled via the switch algorithm.

A number of predefined switch algorithms may be algorithms created for a specific drive circuit and a specific flash tube in order to achieve desired characteristics of the emitted light. Several predefined algorithms may be stored in the control unit.

The input parameter may, according to one aspect of the present disclosure be a measured parameter relating to the properties of the light emitted from the flash tube and/or a measured state of the drive circuit. The control unit is configured to use the measured parameter for feedback regulation of the switch algorithm during the flash.

By measuring parameters or characteristics of the light emitted during a flash or a state of the drive circuit of the flash tube during a flash, it can be assured that the emitted light actually has the desired characteristics. Feedback regulation may be applied to the switch algorithm based on the input parameters. In other words, adjustments to the switch algorithm may be made as the flash is ongoing in order to achieve a flash with desired characteristics wherein the adjustments are based in the input parameters from the emitted light or from the state of the drive circuit.

The state of the drive circuit, such as an electric current through a component connected in series with the flash tube and the capacitor in the drive circuit or a change of voltage across a component connected in series with the flash tube and the capacitor in the drive circuit is indicative of the light emitted from the flash tube. Hence, the state of the drive circuit may be used for feedback regulation of the switch algorithm in order to achieve the desired characteristics of the emitted light from the flash tube.

According to one aspect of the present disclosure, each inductor switch group is associated with a preset maximum current. The control unit of the drive circuit is configured to, based on the input parameter: determine a flash current required to be fed to the flash tube in order to achieve the desired flash characteristics, determine, based on the determined flash current, a switch algorithm used to ensure that no individual inductor switch group has to carry an electric current exceeding the preset maximum current of that inductor switch group, and use the determined switch algorithm to feed the flash current to the flash tube.

The components of the inductor switch groups of the drive circuit normally have a limit of the current that can flow through the components. This limit may according to one embodiment be below the maximum amount of current flowing from the capacitor to the flash tube during a flash. If the maximum limit of the components of the inductor switch group is exceeded, there is a large risk that for example the switches breaks. Hence, when the switch algorithm is created, the maximum limit of each inductor switch group is taken into consideration and the algorithm is created so that the maximum level of current flow through any component is not exceeded. Thereby, the lifetime of the drive circuit will be prolonged. Alternatively, according to one embodiment of the present disclosure larger current flows may be used, compared to the current flows used in the prior art, without damaging the components.

According to one aspect of the disclosure, the control unit is configured to, based on the input parameters, determine a switch algorithm wherein the at least one switch of each inductor switch group is activated sequentially at different points in time. In other words, the at least one switch of each inductor switch groups activated at mutually different points in time.

According to one aspect of the disclosure, the control unit is configured to, based on the input parameters, determine a switch algorithm wherein at least two inductor switch groups are activated at the same point in time.

By turning the at least one switch of each inductor switch group on sequentially, a very accurate control of the current to the flash tube is achieved.

According to another aspect of the present disclosure, there is provided a method for controlling a drive circuit for a flash tube. The drive circuit comprises a capacitor and a first inductor switch group comprising a first inductor and at least one first switch connected in series with each other. The first inductor switch group is configured to be connected in series with the flash tube and the capacitor. The drive unit further comprises at least a second inductor switch group comprising a second inductor and at least one second switch connected in series with each other and configured to be connected in series with the flash tube and the capacitor, and in parallel with the first inductor switch group. The method further comprises the steps of receiving input parameters related to a desired flash characteristics, and controlling the first and second inductor switch groups separately based on the received input parameters to obtain the desired flash characteristics.

According to one aspect of the present disclosure, the drive circuit comprises at least a third inductor switch group. Each inductor switch group comprises an inductor and at least one switch connected in series with each other, wherein each inductor switch group is configured to be connected in series with the electronic flash tube and the capacitor, and connected in parallel with the first inductor switch group as well as the second inductor switch group. The method further comprises the step of controlling each inductor switch group separately.

In other words, each inductor switch group is individually controlled by the control unit and hence is connected to the control unit separately.

According to one aspect of the present disclosure the input parameter used in one step of the method relates to any of, or any combination of: a desired color temperature of the flash, a desired light intensity of the flash and a desired total amount of light emitted during the flash.

According to one aspect of the present disclosure the input parameter used in the method relates to a predefined switch algorithm, wherein the predefined switch algorithm is used during the flash.

According to one aspect of the present disclosure the input parameter used in the method is a measured parameter relating to the properties of the light emitted from the flash and/or a measured state of the drive circuit wherein the measured parameter for feedback regulation of the switch algorithm is used during the flash.

According to one aspect of the present disclosure each inductor switch group is associated with a preset maximum current. The method comprises the steps of, based on the input parameter, determining a flash current required to be fed to the flash tube in order to achieve the desired flash characteristics, determining, based on the determined flash current, a switch algorithm used to ensure that no individual inductor switch group has to carry an electric current exceeding the preset maximum current of that inductor switch group, and using the determined switch algorithm to feed the flash current to the flash tube.

According to a further aspect of the present disclosure, the method comprises the step of, based on the input parameters, determining a switch algorithm wherein the at least one switch of each inductor switch group is activated sequentially at different points in time. In other words, the at least one switch of each inductor switch group is activated at mutually different points in time. By turning the at least one switch of each inductor switch group on sequentially, a very accurate control of the current to the flash tube is achieved.

According to yet another aspect of the present disclosure, there is provided a flash device and a flash generator comprising a drive circuit as described above.

BRIEF DESCRIPTION OF THE DRAWINGS

The present invention will become more fully understood from the detailed description provided hereinafter and the accompanying drawings which are given by way of illustration only. In the different drawings, same reference numerals correspond to the same element.

DETAILED DESCRIPTION

Figure 1:
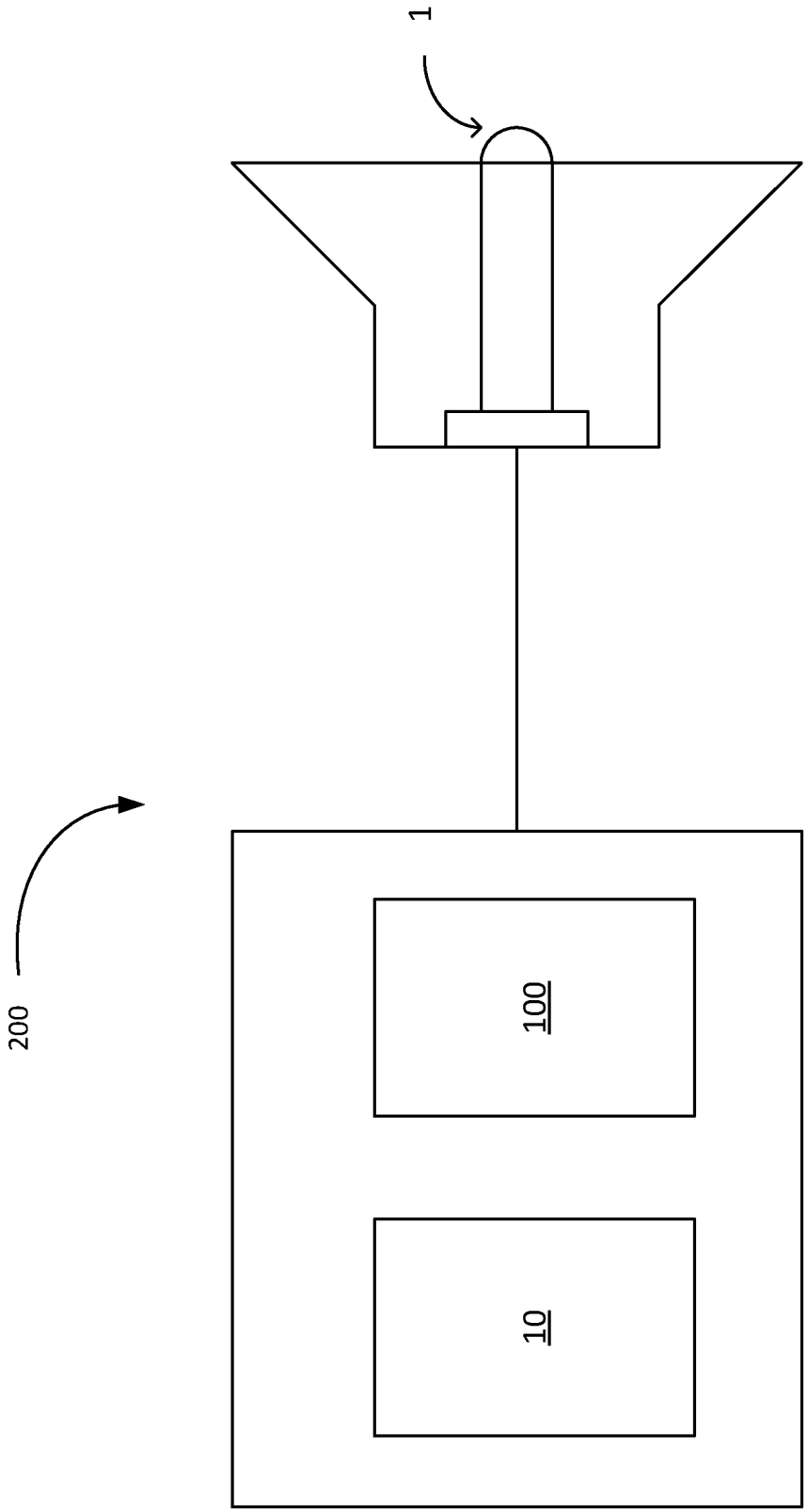
FIG. 1 illustrates a flash apparatus, according to an exemplary embodiment of the present disclosure.

FIG. 1 illustrates a flash apparatus 200 for use in the field of photography. The apparatus comprises a drive circuit 10 for a flash tube 1 and a control unit 100. The flash apparatus 200 is arranged to receive a flash tube 1. The flash apparatus 200 may be a stand-alone unit or may be arranged in a camera with a built in flash tube.

Figure 2:
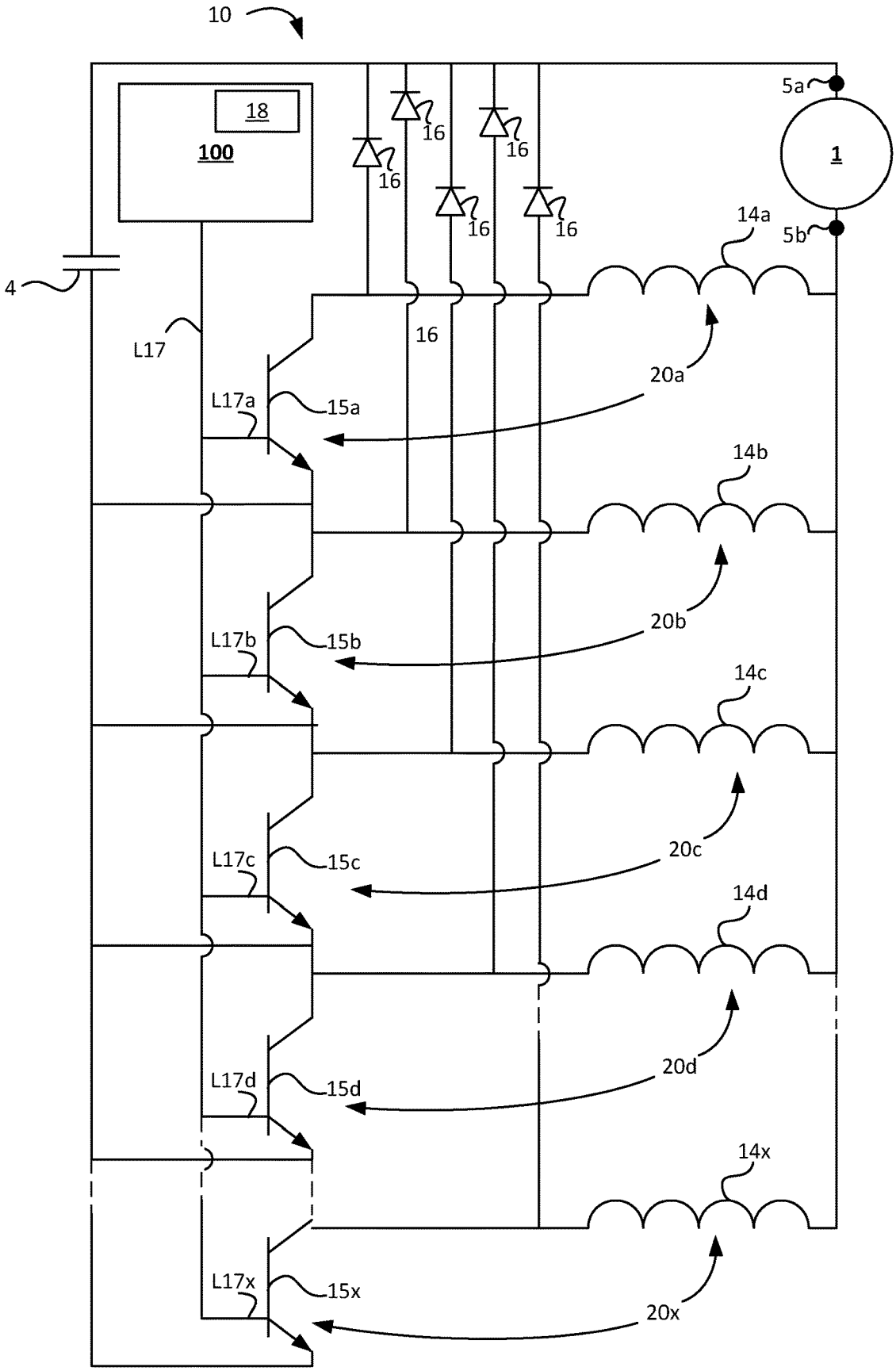
FIG. 2 illustrates a drive circuit according to an exemplary embodiment of the present disclosure.

FIG. 2 illustrates a drive circuit 10 for a flash tube 1. The drive circuit comprises a capacitor 4, a control unit 100, receiving means 5*a*, 5*b* for a flash tube 1 and at least two inductor switch groups 20*a*, 20*b*, 20*c*, 20*d*, . . . , 20*x*. The capacitor 4 is the power source of the circuit 10. The capacitor may be of different types such as a foil type or an electrolytic type. According to the embodiment illustrated in FIG. 2, only one capacitor 4 is illustrated. However, according to one exemplary embodiment, several capacitors are connected to the capacitor circuit, in parallel, enabling more energy to be stored and discharged through the flash tube.

The drive circuit 10 comprises connection points 5*a*, 5*b*, to which a flash tube 1 can be connected. Further, the drive circuit 10 comprises a first inductor switch group 20*a* comprising a first inductor 14*a* and a first switch 15*a*. According to the illustrated embodiment, only one switch 15*a*, 15*b*, 15*c*, 15*d*, . . . , 15*x* is included in each inductor switch group. However, according to a non-illustrated embodiment of the present disclosure, each inductor switch group may include one or more switches. The first inductor 14*a* and the first switch 15*a* are connected in series with each other and flash tube 1 and the capacitor 4. The inductor switch group 20*a* is connected to the control unit 100 via a link L17*a* and a bus L17. A component, such as a diode 16 which only allows current in one direction is connected in series with the flash tube 1 and the inductor 14*a* with one connection point at the conductor between the first switch 15*a* and the first inductor 14*a* and the other connection point at the conductor between the capacitor 4 and the flash tube 1. The component 16 has a polarity opposite to a direction of energy supply from the capacitor 4 to the flash tube 1. Further, the drive circuit 10 comprises up to x inductor switch groups (20 *b*, 20*c*, 20*d*, . . . , 20*x*). Each inductor switch group is connected in series with the flash tube 1 and the capacitor 4 and in parallel with the other inductor switch groups. Each inductor switch group 20*a*, 20*b*, 20*c*, 20*d*, . . . , 20*x* has a component, such as a diode 16 which only allows current in one direction. The component is connected in series with the flash tube 1 and the inductor with one connection point at the conductor between the switch 15*b*, 15*c*, 15*d*, . . . , 15*x* and the first inductor 14*b*, 14*c*, 14*d*, . . . , 14*x* and the other connection point at the conductor between the capacitor 4 and the flash tube 1. The inductor switch groups 20*b*, 20*c*, 20*d*, . . . , 20*x* are individually connected to the control unit 100 via links L17*b*, L17*c*, L17*d*, . . . , L17*x* and a bus L17.

The control unit 100 comprises receiving means 18 arranged to receive input parameters.

Further, the apparatus 200 normally comprises a trigger circuit (not illustrated) arranged to trigger the flash tube 1.

When a flash is desired, the control unit 100 sends a command to the at least one switch of each inductor switch groups 15*a*, 15*b*, 15*c*, 15*d*, . . . , 15*x* to close. After a certain period of time, typically around 10 microseconds, the flash tube 1 is triggered via a triggering circuit or the like. The triggering current causes a number of molecules in the fluid in the flash tube 1 to be ionized. As the molecules in the fluid in the flash tube 1 starts to ionize, the fluid starts to conduct current. At the moment when the fluid becomes a conductor, the capacitor 4 will start to discharge causing a pulse of current through the flash tube 1. The pulse of current will cause the fluid in the flash tube 1 to emit light, and a flash is created.

Figure 3A:
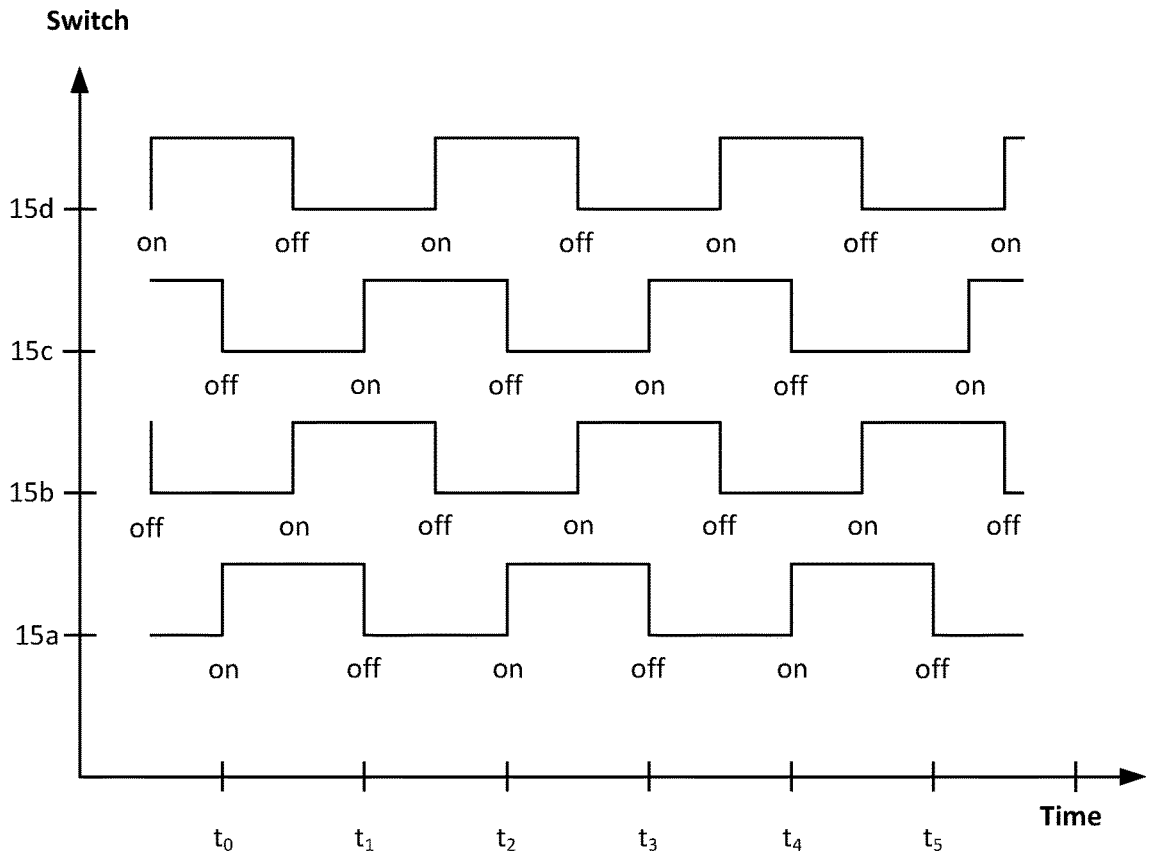
FIG. 3*a* illustrates a schedule over the state of the at least one switch of the inductor switch groups illustrated in FIG. 2.
Figure 3B:
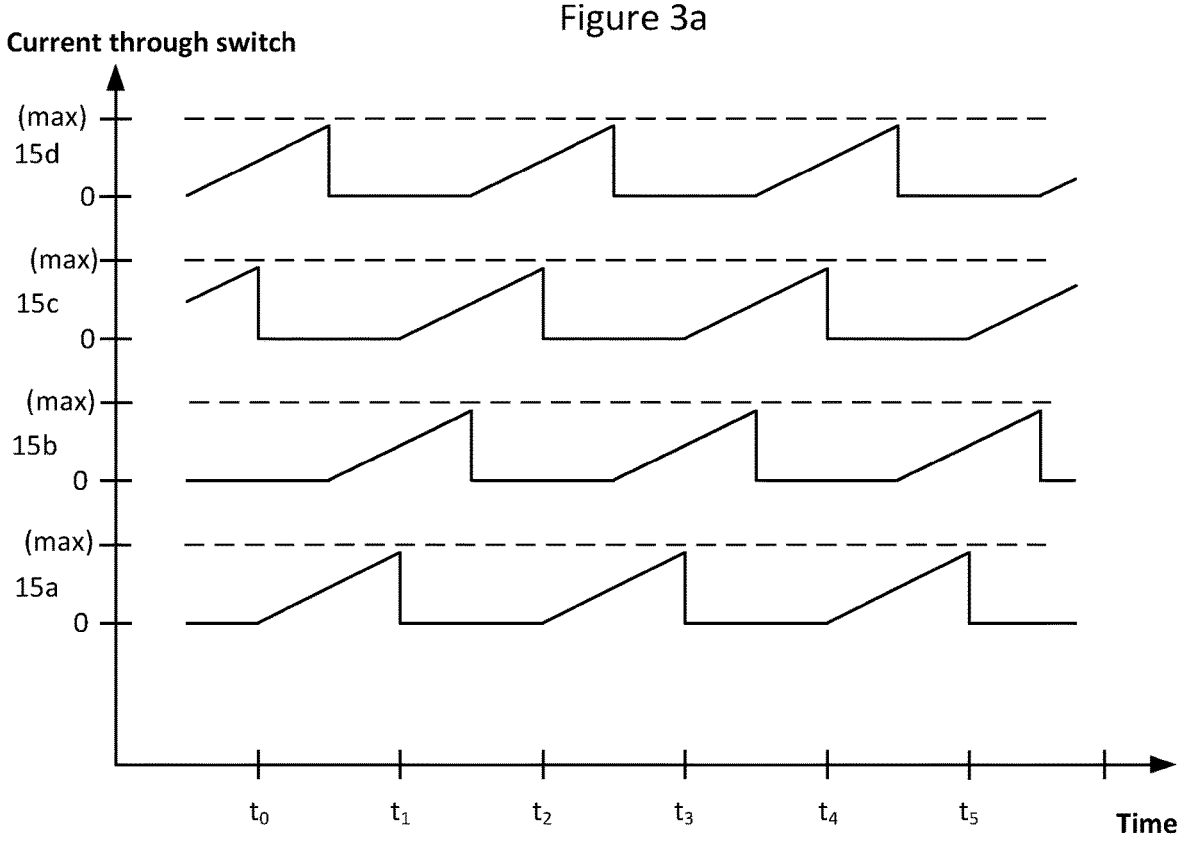
FIG. 3*b* illustrates a chart showing the current led through the at least one switch of the inductor switch groups.
Figure 3C:
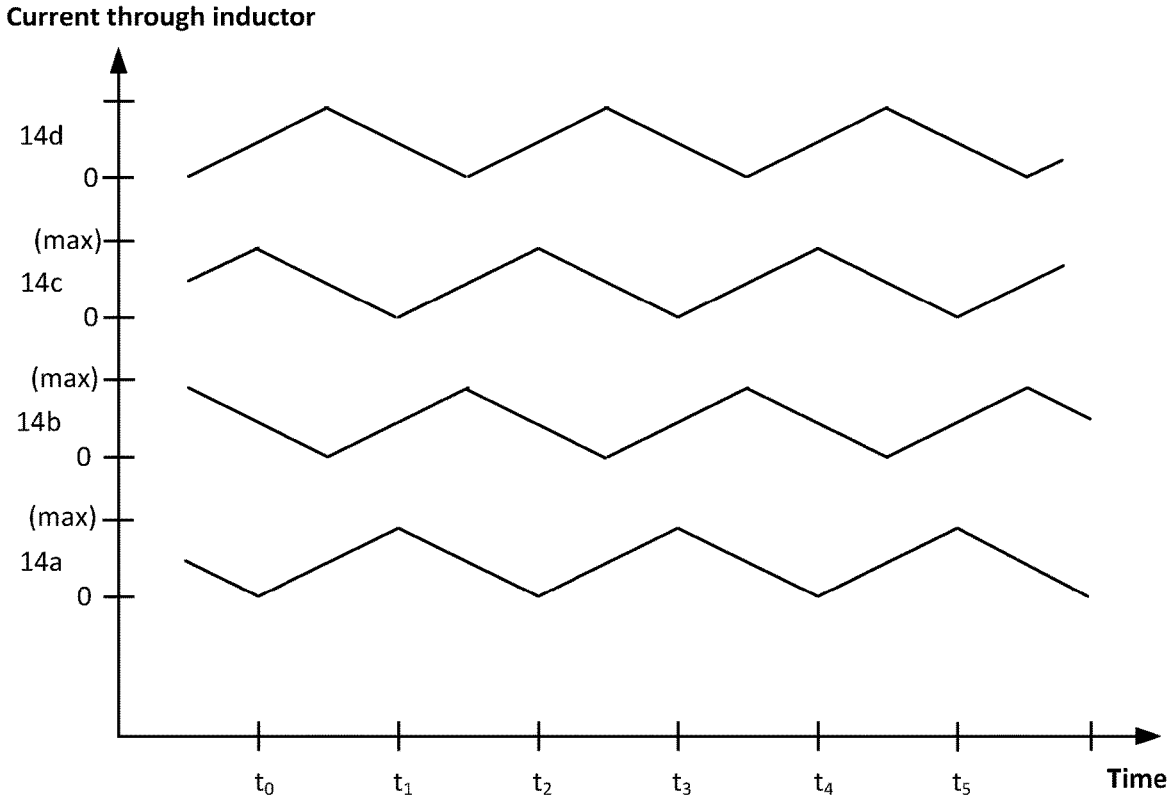
FIG. 3*c* illustrates a chart showing the current led through the inductors of the inductor switch groups.
Figure 3D:
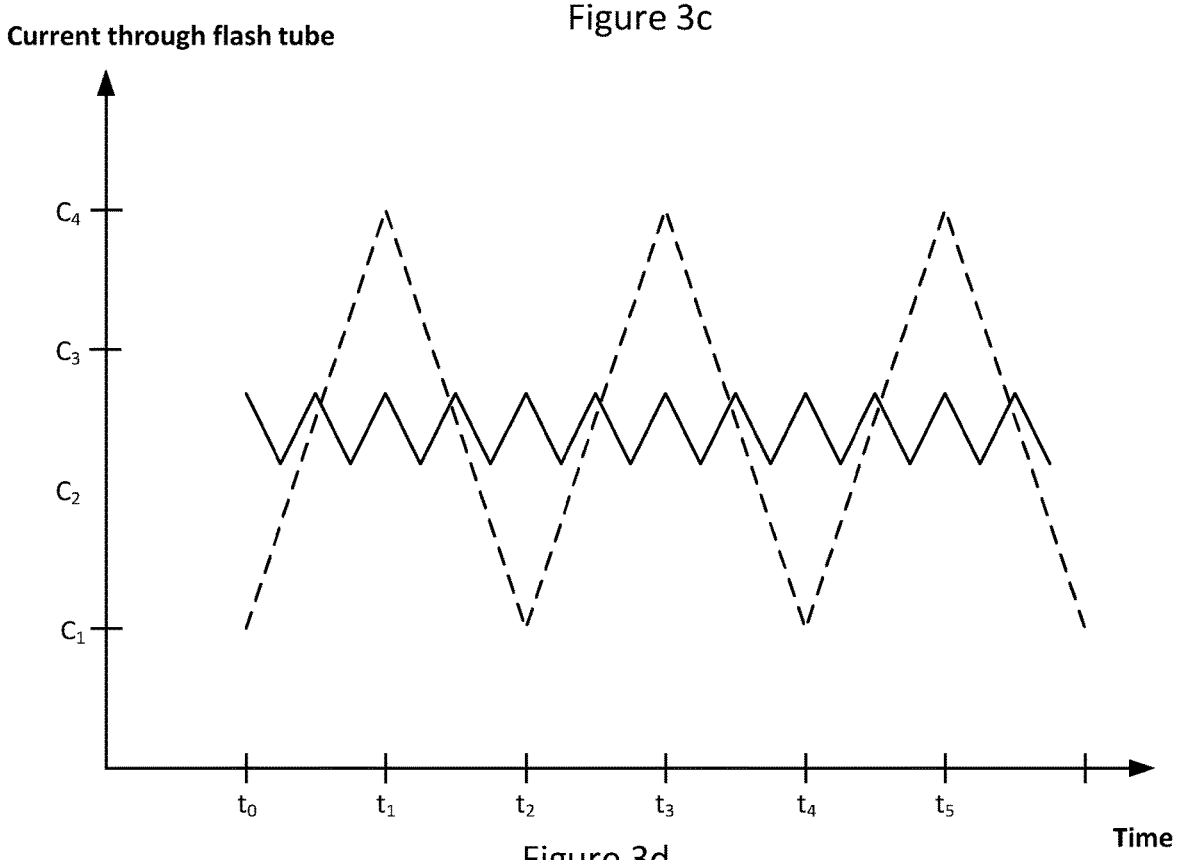
FIG. 3*d* illustrates a chart showing the current led through the flash tube when the schedule according to FIG. 3*a* is used.
Figure 4:
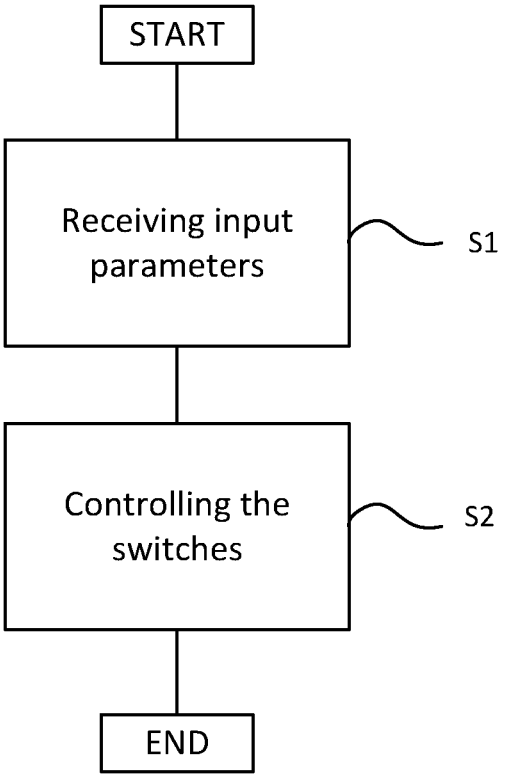
FIG. 4 illustrates a flow chart of the method according to the invention.

According to the exemplary embodiment illustrated in FIG. 2-4, each inductor switch group comprises one switch. However, each inductor switch group may comprise more than one switch. If each inductor switch group comprises a number of switches, these switches are controlled as a unit, where all the switches in each inductor switch group are turned on or off at the same point in time.

The characteristics of the light emitted during the flash, such as the colour temperature of the light, the intensity of the light and the total amount of light emitted during the flash, may be controlled by varying the current flow to the flash tube 1. According to one exemplary embodiment, this is done by using a switch algorithm. The control unit 100 controls the at least one switch 15*a*, 15*b*, 15*c*, 15*d*, . . . , 15*x* of each inductor switch group in the drive circuit according to the switch algorithm. The switch algorithm may be derived from input parameters. According to one exemplary embodiment, the input parameters are parameters derived from the characteristics of the emitted light or the state of the drive circuit during the flash, such as an electric current through or a voltage across a component connected in series with the flash tube. Hence, the switch algorithm may be adjusted during a flash in order to achieve the desired characteristics of the emitted light. According to one exemplary embodiment, the input parameter is a parameter which may be chosen by a user of the flash apparatus before the flash. Typically, the flash apparatus may comprise controls for one or several desired flash characteristics, such as the colour temperature of the emitted light, the intensity of the emitted light, the total amount of emitted light during the flash etc. By varying the controls, the input parameters are varied, and hence, different predefined switch algorithms are chosen.

According to one exemplary embodiment both a predefined switch algorithm and a switch algorithm based on input parameters from the emitted light is used during a flash. Typically, a predefined switch algorithm is used initially. Further, the switch algorithm may be adjusted due to the characteristics of the emitted light and/or the state of the drive circuit of the light.

The switch algorithm may be used during the whole flash or during selected parts of the flash.

Each inductor switch group 20*a*, 20*b*, 20*c*, 20*d*, . . . , 20*x* is associated with a maximum current. If the maximum current is exceeded, the components of the inductor switch group may break or stop functioning. In addition, the life time of the components may decrease. The switch algorithms are created so that no individual inductor switch group 20*a*, 20*b*, 20*c*, 20*d*, . . . , 20*x* has to carry an electric current exceeding the maximum current associated with each inductor switch group 20*a*, 20*b*, 20*c*, 20*d*, . . . , 20*x*. However, due to the construction of the drive circuit 10 and the switch algorithms, each individual inductor switch group 20*a*, 20*b*, 20*c*, 20*d*, . . . , 20*x* may have a maximum current tolerance at a level lower than the total amount of current flowing from the capacitor to the flash tube. According to one exemplary embodiment, the switch algorithm controls the at least one switch of each inductor switch group 20*a*, 20*b*, 20*c*, 20*d*, . . . , 20*x* so that each at least one switch or each inductor switch group is activated at different points in time, sequentially. By turning the at least one switch of each inductor switch group on sequentially, a very accurate control of the current to the flash tube is achieved and the components may be protected from too high levels of current flow.

According to one exemplary embodiment, the switch algorithm controls the switches of at least two inductor switch groups 20*a*, 20*b*, 20*c*, 20*d*, . . . , 20*x* to be activated at the same point in time. Hence, the switch algorithm may be constructed to control an arbitrary number of inductor switch groups as a unit for which the switches are turned on or off at the same point in time during at least part of the flash.

Typically, the switches have a maximum switching rate. Thus, switch algorithms are created so that the desired current is fed to the flash tube at each point in time without exceeding the switching rate for each individual switch. FIG. 3*a* illustrates a section of a switch algorithm according to one exemplary embodiment. For the at least one switch 15*a*, 15*b*, 15*c*, 15*c* of each inductor switch group, the state of the switch is illustrated along a time $t_0$-$t_5$. The state of the each switch is either "on" or "off". According to one exemplary embodiment, the drive circuit 10 comprises four inductor switch groups 20*a*, 20*b*, 20*c*, 20*d* and hence at least four switches 15*a*, 15*b*, 15*c*, 15*d*. At a point in time $t_0$, which is at a random point in time during the execution of the switch algorithm, switch 15*a* is off, switch 15*b* is turned off, switch 15*c* is on, and switch 15*d* is turned on. The period during which the switches are turned on may vary according to the switch algorithm used. According to one exemplary embodiment, the maximum switching rate of each switch is between 10 and 40 kHz. As time passes, the switches 15*a*, 15*b*, 15*c*, 15*d* will be turned off and on depending on the switch algorithm used in that point in time. As the switch algorithm may vary during the flash, the pattern may change during a flash. In addition, each switch 15*a*, 15*b*, 15*c*, 15*d* may have an individual maximum switching rate. The switch algorithm is constructed taking the characteristics of the components of each inductor switch group into consideration. As mentioned before, according to this exemplary embodiment, each inductor switch group comprises one switch. However, each inductor switch group may comprise more than one switch. If each inductor switch group comprises a number of switches, these switches are controlled as a unit, such that all the switches in each inductor switch group are turned on or off at the same point in time.

The switch algorithm illustrated in FIG. 3*a* is merely an example. The switch algorithm may be varied freely as long as the restrictions of the components are taken into consideration in order to achieve the desired characteristics of the emitted light.

FIG. 3*b* schematically illustrates the current through each switch 15*a*, 15*b*, 15*c*, 15*d* when the switch algorithm according to FIG. 3*a* is executed in the drive circuit. At the time $t_0$, switch 15*a* is turned on. Due to the laws of electronic, from the point in time when the switch in the inductor switch group is closed or turned on, the current through the switch increases with a certain rate depending on for example the properties of the inductor in the inductor switch group and also on the voltage across the inductor. The switch algorithm is constructed so that before the current through the switch 15*a* reaches the maximum level for that specific component, the switch is turned off. Switch 15*a* is turned off at $t_1$. The switch 15*a* is turned off until $t_2$ when the switch 15*a* is turned on again. According to the switch algorithm, the switches are turned off before the current through the switches reaches a maximum level for each individual switch thereby increasing the lifetime of the drive circuit and the components therein.

FIG. 3*c* illustrates the current flow through the inductors of each inductor switch group using the switch algorithm as illustrated in FIG. 3*a*. As can be seen, when the switches of each individual inductor switch group is turned off, due to the laws of electronics, the current through the inductors will continue for a period of time after the switch has been turned off. After the switches have been turned off, the current will continue to circulate through the inductor, the diode connected in series with the inductor and the flashtube for some time before the current stops to flow.

FIG. 3*d* schematically illustrates with a solid curve the current flow to the flash tube in the drive circuit between $t_0$ and $t_5$ using the switch algorithm as illustrated in FIG. 3*a*. According to the algorithm, the current sent to the flash tube is never turned off completely, but is kept between a level $c_3$ and a level $c_4$. As can be seen, the current flow through the flash tube can be kept at a rather even level with only small variations. According to one embodiment, an almost constant current flow through the flash tube may be achieved by adjusting the switch algorithm.

The dashed curve in FIG. 3*d* illustrates the current flow to the flash tube using prior art where the switches of a single inductor switch group are controlled to switch on or off at the same time. As can be seen, the result of this method is much larger variation of the current flow through the flash tube, and, the changing rate is notably slower compared to the current flow when using the switch algorithm in FIG. 3*a*.

FIG. 4 is a flow chart illustrating a method for controlling a drive circuit 10 for a flash tube 1, according to one embodiment of the present disclosure.

In a first step, S1, input parameters related to a desired flash characteristic are received. A switch algorithm is either chosen from a number of predefined switch algorithms, or, a switch algorithm is created based in the input parameters. The input parameters may be the characteristics of the emitted light during the flash, the state of the drive circuit of the flash tube or alternatively or a desired characteristics of the light emitted during the flash. A desired characteristics of the light emitted may be a certain total amount of light emitted during the flash and this desired characteristics may be chosen by varying a control on a flash device comprising the drive circuit 10, such as a button for example. By setting the button in a specific position, a certain desired characteristics of the future flash has been entered into the control unit. The control unit may create a switch algorithm based on the input parameter or, a predefined switch algorithm stored in the control unit may be used.

In a second step, S2, at least a first and a second switch of at least a first and a second inductor switch group forming part of the drive circuit 10 are controlled via the switch algorithm.

What is claimed is:

1. A drive circuit for a flash tube comprising:

a capacitor;

a first inductor switch group comprising a first inductor and at least one first switch connected in series with each other, the first inductor switch group being configured to be connected in series with the flash tube and the capacitor;

a control unit comprising receiving means for receiving at least one input parameter related to a desired flash characteristics; and a second inductor switch group comprising a second inductor and a second switch connected in series with each other, the second inductor switch group being configured to be connected in series with the flash tube and the capacitor, and being connected in parallel with the first inductor switch group, wherein the control unit is configured to control the first and second inductor switch groups separately based on the at least one input parameter to obtain the desired flash characteristics, and wherein each inductor switch group is associated with a preset maximum current, the control unit being configured to, based on the input parameter:

determine a flash current required to be fed to the flash tube in order to achieve the desired flash characteristics, determine, based on the determined flash current, a switch algorithm used to ensure that no individual inductor switch group has to carry an electric current exceeding the preset maximum current of that inductor switch group, and use the determined switch algorithm to feed the flash current to the flash tube.

2. The drive circuit according to claim 1 wherein the drive circuit comprises at least a third inductor switch group each inductor switch group comprising an inductor and at least one switch connected in series with each other, wherein each inductor switch group is configured to be connected in series with the flash tube and the capacitor, and connected in parallel with the first inductor switch group as well as the second inductor switch group wherein the control unit is configured to control each inductor switch group separately.

3. The drive circuit according to claim 1 wherein the input parameter relates to any of, or any combination of:

a desired color temperature of the flash, a desired light intensity of the flash, and a total amount of light emitted during the flash.

4. The drive circuit according to claim 1 wherein the input parameter relates to a predefined switch algorithm wherein the control unit is configured to use the predefined switch algorithm during the flash.

5. The drive circuit according to claim 1 wherein the input parameter is a measured parameter relating to the properties of the light emitted from the flash tube and/or a measured state of the drive circuit wherein the control unit is configured to use the measured parameter for feedback regulation during the flash.

6. The drive circuit according to claim 1 wherein the control unit is configured to, based on the input parameters:

determine another switch algorithm wherein the at least one switch of each inductor switch group is activated sequentially at different points in time.

7. A method for controlling a drive circuit for a flash tube, the drive circuit comprising a capacitor, a first inductor switch group comprising a first inductor and at least one first switch connected in series with each other, the first inductor switch group being configured to be connected in series with the flash tube and the capacitor, and at least a second inductor switch group comprising a second inductor and at least one second switch connected in series with each other and configured to be connected in series with the flash tube and the capacitor, and in parallel with the first inductor switch group, the method comprising:

receiving input parameters related to a desired flash characteristics, and controlling the first and second inductor switch groups separately based on the received input parameters to obtain the desired flash characteristics, and wherein each inductor switch group is associated with a preset maximum current, wherein the method comprises the steps of, based on the input parameter;

determining a flash current required to be fed to the flash tube in order to achieve the desired flash characteristics, determining, based on the determined flash current, a switch algorithm used to ensure that no individual inductor switch group has to carry an electric current exceeding the preset maximum current of that inductor switch group, and using the determined switch algorithm to feed the flash current to the flash tube.

8. The method according to claim 7 wherein the drive circuit comprises at least a third inductor switch group each inductor switch group comprising an inductor and at least one switch connected in series with each other, wherein each inductor switch group is configured to be connected in series with the flash tube and the capacitor, and connected in parallel with the first inductor switch group as well as the second inductor switch group, the method comprising the step of:

controlling each inductor switch group separately.

9. The method according to claim 7, wherein the input parameter relates to any of, or any combination of:

a desired color temperature of the flash, a desired light intensity of the flash, and a total amount of light emitted during the flash.

10. The method according to claim 7, wherein the input parameter relates to a predefined switch algorithm, wherein the predefined switch algorithm is used during the flash.

11. The method according to claim 7, wherein the input parameter is a measured parameter relating to the properties of the light emitted from the flash and/or a measured state of the drive circuit wherein the measured parameter fir feedback regulation used during the flash.

12. The method according to claim 7 wherein the method comprises the step of, based on the input parameters:

determining another switch algorithm wherein at east one switch of each inductor switch group is activated sequentially at different points in time.

* * * * *